US010280668B2

(12) United States Patent
Kelley

(10) Patent No.: US 10,280,668 B2
(45) Date of Patent: May 7, 2019

(54) GARAGE DOOR NOISE REDUCTION ROLLER ASSEMBLY

(71) Applicant: Robert A. Kelley, Moreno Valley, CA (US)

(72) Inventor: Robert A. Kelley, Moreno Valley, CA (US)

(73) Assignee: UNIQUE GARAGE DOOR INC., Buena Park, CA (US)

( * ) Notice: Subject to any disclaimer, the term of this patent is extended or adjusted under 35 U.S.C. 154(b) by 0 days.

(21) Appl. No.: 15/338,410

(22) Filed: Oct. 30, 2016

(65) Prior Publication Data

US 2018/0002962 A1 Jan. 4, 2018

Related U.S. Application Data

(63) Continuation-in-part of application No. 14/827,259, filed on Aug. 14, 2015.

(51) Int. Cl.
*E05D 15/24* (2006.01)

(52) U.S. Cl.
CPC ..... *E05D 15/242* (2013.01); *E05Y 2800/422* (2013.01); *E05Y 2800/46* (2013.01); *E05Y 2800/676* (2013.01); *E05Y 2900/106* (2013.01)

(58) Field of Classification Search
CPC ..... E05D 15/242; E05D 15/24; E05D 15/16; E05D 15/165; E05D 11/00; E05Y 2900/106; E05Y 2900/108; Y10T 16/536075; Y10T 16/53608; Y10T 16/082; F16C 33/34; F16C 33/38; F16C 33/3831
USPC ..... 49/197–199
See application file for complete search history.

(56) References Cited

U.S. PATENT DOCUMENTS 2,233,351 A * 2/1941 Rowe ..... E05D 15/165 16/104
2,266,042 A * 12/1941 Hufferd ..... E05D 15/165 16/107
2,525,309 A * 10/1950 Norberg ..... E05D 15/165 16/104
2,645,807 A * 7/1953 McKee ..... E05D 15/165 16/104
3,554,621 A * 1/1971 McAllister ..... F16C 33/3831 384/484
3,680,934 A * 8/1972 Laussermair ..... F16C 19/26 384/564

(Continued)

*Primary Examiner* — Katherine W Mitchell
*Assistant Examiner* — Abe Massad
(74) *Attorney, Agent, or Firm* — Thomas I. Rozsa

(57) ABSTRACT

A roller with a Delrin plastic injection to coat the steel shaft wherein the plastic coated shaft eliminates the metal-to-metal contact that creates the noise. The new and improved Delrin plastic coated shaft will be 1 mm larger than industry standard shafts because 10-11 mm industry standard shafts are too loose in the hinge barrels which allows the rattling. This improved roller shaft is 12 mm at finished thickness to reduce the extra space. A roller wheel connected to a roller shaft being a portion of a hinge affixed to a garage door, the roller wheel adapted to roll within a track of a garage door, the roller wheel including at least one ball bearing and a collar retained in a circumferential cylindrical middle cover seal and the circumferential cylindrical middle cover seal covered with a steel cover, the steel cover covered with 50-90 durometer soft urethane plastic.

3 Claims, 9 Drawing Sheets

(56) References Cited

U.S. PATENT DOCUMENTS

| | | | | |
|---|---|---|---|---|
| 4,205,713 | A * | 6/1980 | Galbreath | E05D 15/165 160/201 |
| 4,379,479 | A * | 4/1983 | Whiting | B60J 5/08 16/97 |
| 4,924,932 | A * | 5/1990 | Esnault | E05D 15/12 160/201 |
| 5,235,724 | A * | 8/1993 | Perrin | E05D 15/165 16/223 |
| 5,447,377 | A * | 9/1995 | Baumgartner | F16C 13/006 384/477 |
| 6,185,783 | B1 * | 2/2001 | Carpinella | E05D 15/165 16/107 |
| 6,553,618 | B2 * | 4/2003 | Whitley | E05D 15/165 16/107 |
| 6,729,380 | B2 * | 5/2004 | Whitley | E05D 15/165 16/DIG. 6 |
| 8,454,240 | B2 * | 6/2013 | Doyer | F16C 33/416 384/470 |
| 9,233,798 | B2 * | 1/2016 | Srb-Gaffron | B66B 23/145 |
| 9,856,685 | B1 * | 1/2018 | Kelley | E05D 15/242 |
| 2007/0234517 | A1 * | 10/2007 | Larson | E05D 11/087 16/342 |
| 2013/0104341 | A1 * | 5/2013 | Kenerly | E05D 3/02 16/273 |

* cited by examiner

GARAGE DOOR NOISE REDUCTION ROLLER ASSEMBLY

CROSS-REFERENCE TO RELATED APPLICATION

This patent application is a continuation-in-part of application Ser. No. 14/827,259 filed on Aug. 14, 2015, now pending.

BACKGROUND OF THE INVENTION

1. Field of the Invention

The present invention relates to the field of garage doors and in particular, to garage door rollers. These rollers allow the garage door to open and close along a guide track. Rollers are located on either side of the garage door and are positioned within a respective track located on opposite sides of a garage door. The rollers roll along a track as the garage door is raised or lowered. Each roller is respectively affixed to a collar by which the respective roller is retained. Each respective roller is affixed to a receiving member of a respective garage door hinge plate which in turn is affixed to a garage door plate, which in turn is affixed to a garage door. The present invention relates to improvements in the roller to reduce the noise created by the steel roller shaft hitting the respective garage door plate as the garage door is raised and lowered.

2. Description of the Prior Art

In the prior art which is known to the present inventor, most garage door rollers have a plated steel shaft that slides into a tube just slightly larger than the diameter of the shaft. This tube is part of a hinge that the roller is retained in to help move the sectional garage door up and down. The hinge is attached to multiple sections of the garage door. The shaft of the roller and tube of the hinge are made of steel. The gap between the roller shaft and the hinge tube allow it to move freely and side to side without binding or sticking. The problem is that the gap/clearance and both the roller shaft and hinge tube barrel being made of steel causes noise and rattling by the metal-to-metal contact as the garage door is raised and lowered. Putting lubricant between the shaft of the roller and the tube into which it is inserted provides some lubricant benefit but still does not significantly reduce the noise and rattling of the assembly.

The problem is not the roller wheel itself because that is not where the noise comes from. The noise comes from the steel shaft of the roller wheel that slides into a hinge bracket in the hinge affixed to garage door sections. The steel garage door hinges and fixtures have a tube or round bracket that retains the roller's shaft. This allows the roller to be retained and allows the shaft to move freely side to side. As the garage door rolls up and down, the rollers move freely and the space in between the tube and roller shaft causes a rattle because of the metal-to-metal contact. This is why the door sounds shaky and noisy when it is in motion. Greasing or lubricating the rollers will not fix the problem of the rattling sound. Even installing the quietest belt drive garage door opener with the quietest hinges and best precision ball rollers will not guarantee that the door will be rattle-free in operation.

In the prior art, the rollers are affixed to a metal shaft which is in turn affixed to a plate, which in turn is affixed to the rear of a garage door so that as the garage door is raised, the rollers which are positioned on opposite sides of the garage door and also positioned within a track, roll or rotate within the track to enable the garage door to be raised or lowered. The rollers are affixed to the shaft and the shafts that are usually made of metal make a clanging and unpleasant noise as the garage door is raised up and down. The problem with the prior art is that the shaft of the rollers is metal and the shaft comes into metal-to-metal contact with the plate to which the shaft is inserted so that there is a constant clanging noise as the garage door is raised and lowered. One other solution that has been attempted in prior art is to create a plastic hinge barrel but strength is sacrificed and the customer usually perceives the plastic hinge barrel to be weak and inferior. Further, the gap remaining between the plastic hinge barrel and the door still creates a rattling noise while traveling up and down. The gap between the shaft of the roller and the tube into which the shaft is inserted still remains and still creates a lot of noise when the garage door is raised and lowered. There is a significant need for a quieter roller shaft assembly so that there is less noise when the garage door is raised and lowered.

The prior art does not significantly reduce the noise created by the shaft of a roller inserted into a tube or hinge bracket as the roller moves up and down to enable the garage door to be raised and lowered. In the garage door, there are tracks on either side of the garage door and a roller is inserted into each track in order to enable the garage door to be raised and lowered. There may be multiple rollers along various lengths of the garage door and in particular, affixed to respective horizontal panels of the garage door. The roller in turn is attached to a shaft which in turn is inserted into a tube that is affixed to a hinge attachment plate which is affixed to the garage door. Therefore, as the garage door is raised and lowered, the metal of the shaft from the roller and the metal of the tube into which the shaft is inserted, have a metal-to-metal contact creating a lot of noise as the garage door is raised and lowered.

There is a significant need in the garage door industry for a quieter garage door roller. Over the years, rollers have been made of steel and plastic, with and without bearings and a plastic cover put over the roller wheel itself as improvements to make them quieter, which has not significantly reduced the noise. It has been discovered that a reduction in the noise of the rollers placed within the track will significantly reduce the noise created when the garage door is raised and lowered. Therefore, there is a significant need to improve the roller itself which is inserted into the track where there is a pair of oppositely disposed rollers in each track affixed to the back of the garage door through the above-referenced attachment plate. While the parent invention significantly helps in reducing the noise, there is still a significant need to further reduce the noise created by rollers which are inserted into the oppositely disposed tracks wherein the garage door is raised and lowered through the rollers rolling on the oppositely disposed tracks.

SUMMARY OF THE INVENTION

The present invention is an apparatus to reduce noise created by the shaft of a respective roller being inserted into a respective metal retaining member of a respective hinge plate where a multiplicity of hinge plates are affixed to adjacent panels of a garage door while a pair of oppositely disposed rollers respectively travel along a pair of oppositely disposed tracks adjacent opposite ends of a garage door panel as the garage door is raised and lowered.

The present invention is also an improvement in the roller which is inserted into the garage door track to significantly reduce the noise created by prior art rollers as the rollers roll in the garage door track.

Through experiments performed by the present inventor, it has been discovered that if the roller shaft is coated with or covered with a hard thermoplastic injection molding, then the metal-to-metal noise of the roller shaft retained in the metal barrel of a hinge plate is significantly reduced when the garage door is raised or lowered.

According to the present inventor, it has been discovered that an improved roller assembly is created with ball bearings and a hard plastic tire such as a Delrin plastic tire and a thermoplastic injection molded covered roller shaft. The difference would be a thermoplastic injection molded roller shaft cover. The thermoplastic injection molded shaft cover would be thin enough to still provide side-to-side non-binding movement. It would also provide a cushion/sound absorption effect and eliminate metal-to-metal contact. Thermoplastic injection molded material is tough enough to resist the chemicals that the door hinge is subject to when lubricated. It should be noted that other types of plastic and urethane covering the roller shaft are also within the spirit and scope of the present invention to achieve the same result.

It has been further discovered that utilizing thermoplastic injection molded material is the most cost effective way to achieve the quiet rattle-free operation of the roller plus chemical resistance. The thermoplastic injection molded will remain on the roller shaft with or without the use of glues or adhesive. Not having to use glues or adhesives makes it very cost effective. Therefore, the thermoplastic injection molded covered roller shaft could be offered on most garage door rollers at very little cost to the homeowner for a much greater rattle-free garage door. In addition, the thermoplastic injection molded covered roller shafts fit most standard garage door hinges.

It has further been discovered according to the present inventor that reducing the diameter of the steel on the roller shaft and adding the injection molded plastic on the top will not achieve a lasting result. Injection molded plastic on a smooth steel shaft will result in failure. The weight of the garage door transfers through the hinge and onto the shaft. The weight plus the side-to-side friction and force of motion on the roller shaft will push the plastic cover off like a tube.

It has been discovered that a significant improvement is to have threads or grooves or a valley on the roller shaft to facilitate an extra grip for the injection molded plastic to grab onto. A gripping joint to allow injection molded plastic to penetrate and wrap around the roller shaft will significantly reduce the noise of the garage door as it moves up and down. With the plastic embedded in and around the steel shaft of the roller, there is very reduced possibility for it to become loose or dislodged from the roller shaft. This provides a permanent lock and bond to the roller shaft. It also results in a long lasting achievable noise reducing assembly to enable the rollers to roll up and down within their tracks and reduce the noise by eliminating a metal-to-metal contact between the shaft of the roller and the tube of the hinge which attaches the assembly to the garage door.

Subsequent to the filing of the parent application, the present inventor also discovered that when the roller (also called roller wheel) is covered with a 50 to 90 durometer soft urethane plastic, the noise of the roller as it rolls on the garage door track is significantly reduced from the noise created by prior art rollers. Prior art rollers are made from a hard plastic wheel or can also be made from a steel wheel. They can also be made with a thin hard plastic cover.

Defined in detail, the present invention is a roller wheel connected to a roller shaft covered with a plastic tube being a portion of a hinge affixed to a garage door, the roller wheel adapted to roll within a track of a garage door, the roller wheel comprising: (a) seven ball bearings and a collar retained in a circumferential cylindrical middle cover seal and the circumferential cylindrical middle cover seal covered with a steel cover, the steel cover covered with 50-90 durometer soft urethane plastic, and (b) said collar retaining said roller shaft covered with a plastic tube; (c) whereby, said 50-90 durometer soft urethane plastic serves to reduce noise created when the roller wheel rolls within said track of said garage door.

Defined more broadly, the present invention is a roller wheel connected to a roller shaft being a portion of a hinge affixed to a garage door, the roller wheel adapted to roll within a track of a garage door, the roller wheel comprising: (a) at least one ball bearing and a collar retained in a circumferential cylindrical middle cover seal and the circumferential cylindrical middle cover seal covered with a steel cover, the steel cover covered with 50-90 durometer soft urethane plastic, and (b) said collar retaining said roller shaft.

Defined most broadly, the present invention is a roller wheel adapted to roll within a track of a garage door, the roller wheel comprising: a ball bearings retaining collar retained in a circumferential cylindrical middle cover seal and the circumferential cylindrical middle cover seal covered with a steel cover, the steel cover covered with 50-90 durometer soft urethane plastic.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention addresses the following problem with noise created when a garage door is moving up or down. The problem is not the roller wheel itself because that is not where the noise comes from (this analysis has been revised in this CIP application). The noise comes from the steel shaft of the roller that slides into the hinge and fixtures (top and bottom door brackets) of the garage door. The steel garage door hinges and fixtures have a tube or round bracket that retains the roller's shaft. This allows the roller to be retained and allows the shaft to move freely side to side. As the garage door rolls up and down, the rollers move freely and the space in between the tube and roller shaft causes a rattle because of the metal-to-metal contact. This is why the door sounds shaky and noisy when it is in motion. Greasing or lubricating the rollers will not fix the problem of the rattling sound. Even installing the quietest belt drive garage door opener with the quietest hinges and best precision 13-ball rollers will not guarantee that the door will be rattle-free in operation.

The present invention is a roller with a Delrin plastic injection to coat the steel shaft wherein the plastic coated shaft eliminates the metal-to-metal contact that creates the noise. The new and improved Delrin plastic coated shaft will be 1 mm larger than industry standard shafts because 10-11 mm industry standard shafts are too loose in the hinge barrels which allows the rattling. This improved roller shaft is 12 mm at finished thickness to reduce the extra space. Closing the gap between the roller shaft and hinge barrel will eliminate the metal-to-metal contact resulting in a very quiet, rolling garage door. By keeping the finished thickness at 12 mm on the new shaft, the roller will still work on new and old garage door hinges and fixtures. This makes the new and improved roller shaft a truly universal product that will work on 90% of garage doors.

Figure 1:
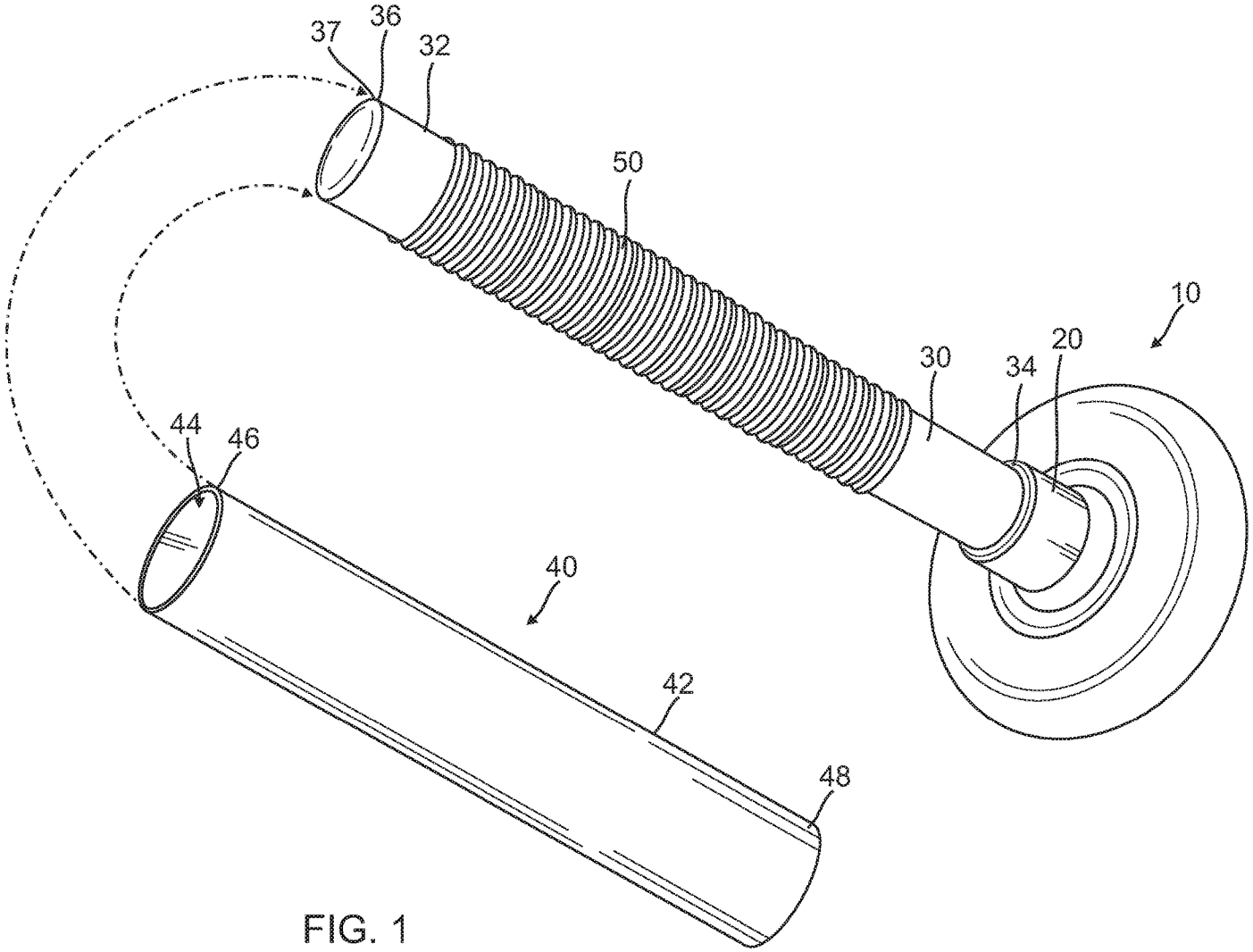
FIG. 1 is an exploded view illustrating a roller with a collar retaining a metal shaft extending from the roller and the present invention threads formed into the roller shaft and the plastic tube about to be inserted and threaded onto the shaft of the roller.

Referring to FIG. 1, there is illustrated a perspective view which includes a conventional roller wheel 10 which is placed into a track of a garage door so that a garage door can be rolled up and down with a pair of oppositely disposed rollers respectively set within oppositely disposed tracks adjacent opposite ends of the garage door. The roller wheel 10 includes a collar 20 with the roller shaft 30 retained into the roller wheel 10 by the collar 20. The innovation of the present invention is to retain a plastic tube or tire 40 made out of material as described above selected from the group consisting of hard thermoplastic (such as Delrin), polyurethane and durable synthetic plastics. The plastic tube or tire 40 has a cylindrical outer wall 42 and a cylindrical inner chamber 44 surrounded by the cylindrical outer wall 42 and open at both a first end 46 and a second end 48. A tube retaining member 50 is formed into the outer cylindrical wall 32 of the roller shaft 30. As illustrated in FIG. 1, the retaining member 50 is selected from the group consisting of treads, threads and screw threads 60 are cut or otherwise formed into the outer wall 32 of roller shaft 30. The plastic tube 40 is injection molded on the roller shaft 30 and press molded against the threads 50 and is thereby securely retained on the roller shaft 30.

Figure 2:
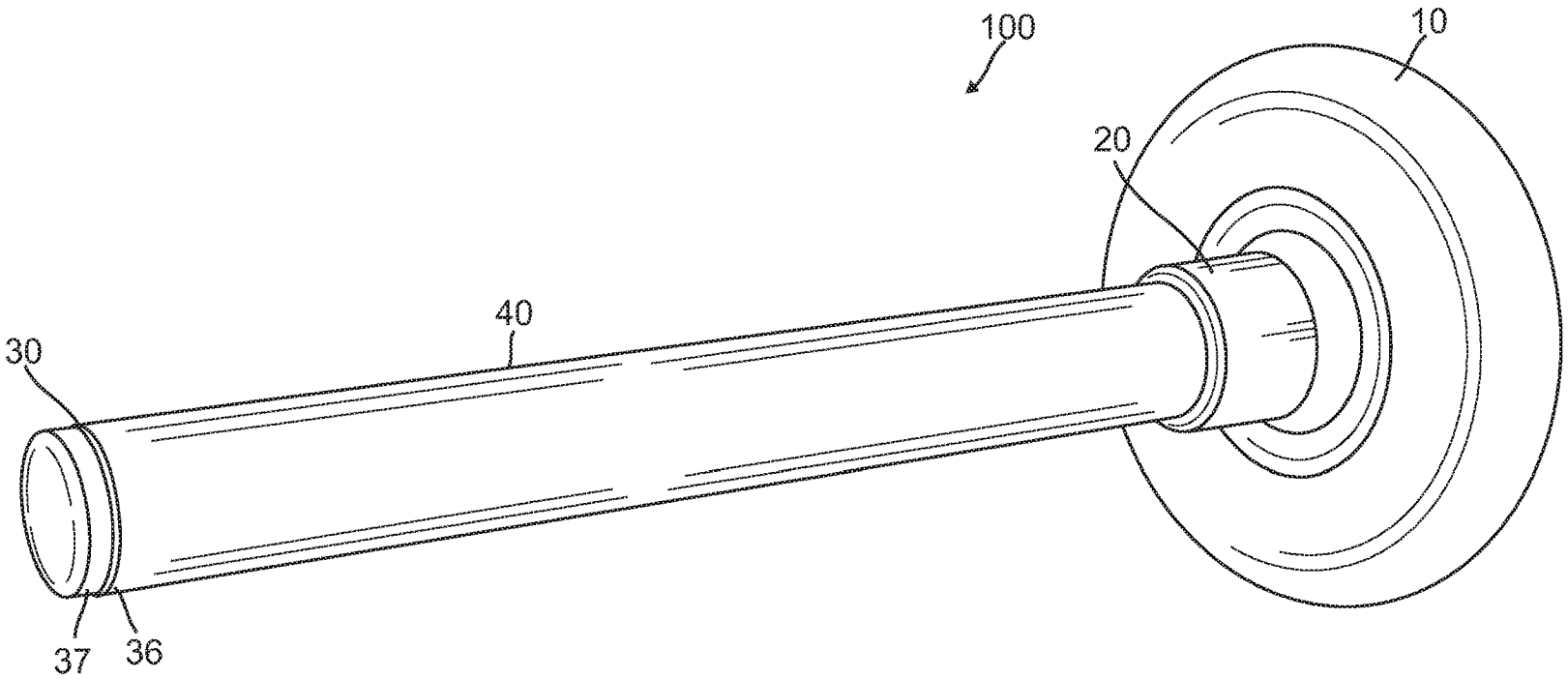
FIG. 2 is a perspective view of the roller shown with the plastic injection molded tube encircling the metal shaft of the roller and having been threaded onto the metal shaft of the roller through the threads on the metal shaft which are part of the present invention.

Referring to FIG. 2, there is illustrated a perspective view of the completed present invention roller wheel assembly 100 which includes the roller wheel 10, the injection molded plastic tube 40 encircling the metal shaft 30 retained at a first end 34 through the collar 20 and into the roller wheel 10, the plastic tube 40 having been injection molded onto or press fit onto the metal shaft 30. A detent 37 is at the second end 36 of the metal shaft 30 to be crimped or have a retention member thereon to prevent the metal shaft from sliding out of the brackets of the hinge member (See FIG. 6).

Figure 3:
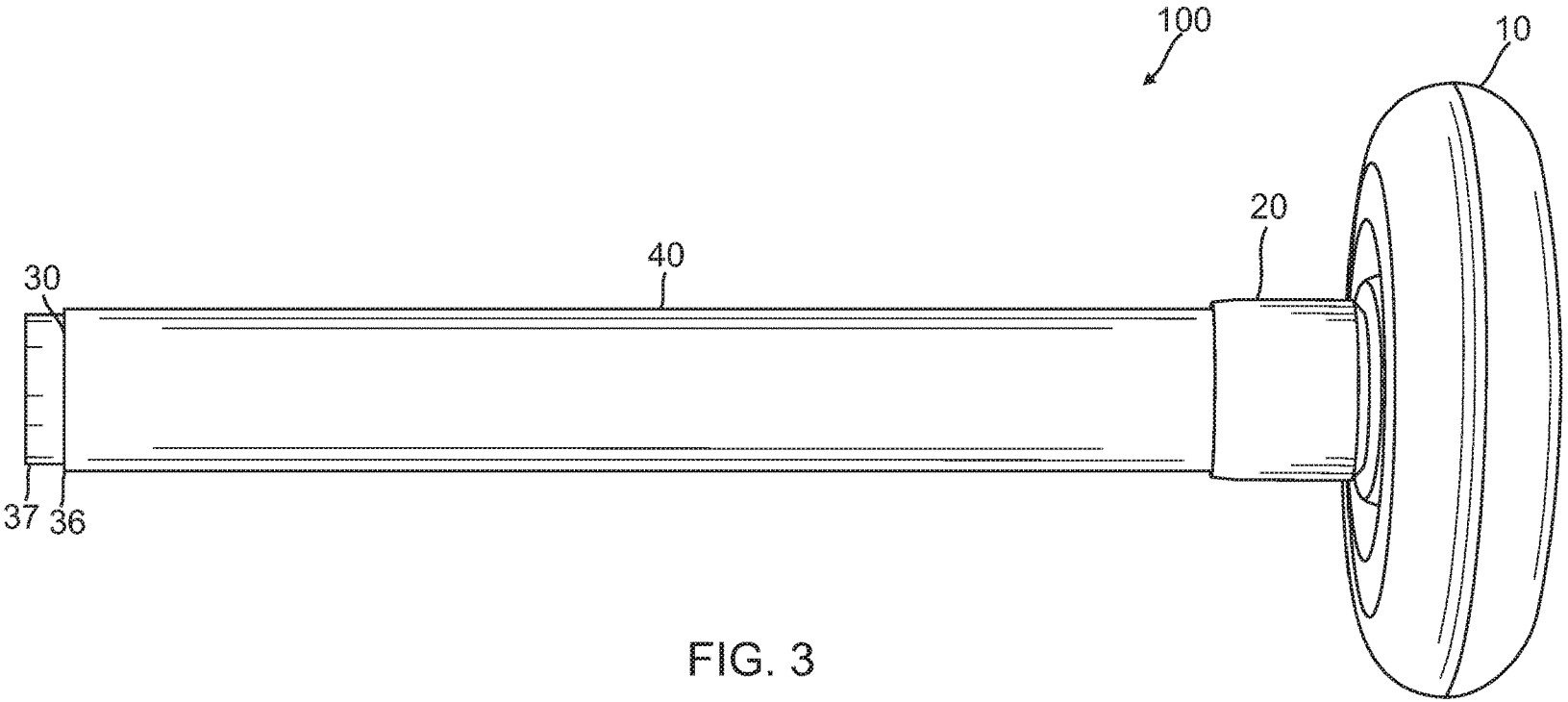
FIG. 3 is a side view of the roller shown with the plastic injection molded tube encircling the metal shaft of the roller and having been threaded onto the metal shaft of the roller through the threads on the metal shaft which are part of the present invention.

Referring to FIG. 3, there is illustrated a perspective view of the completed present invention roller wheel assembly 100 which includes the roller wheel 10, the injection molded plastic tube 40 encircling the metal shaft 30 retained at a first end 34 through the collar 20 and into the roller wheel 10, the plastic tube 40 having been molded onto or press fit onto the metal shaft 30. A detent 37 is at the second end 36 of the metal shaft 30 to be crimped or have a retention member thereon to prevent the metal shaft from, sliding out of the brackets of the hinge member (See FIG. 6).

Figure 4:
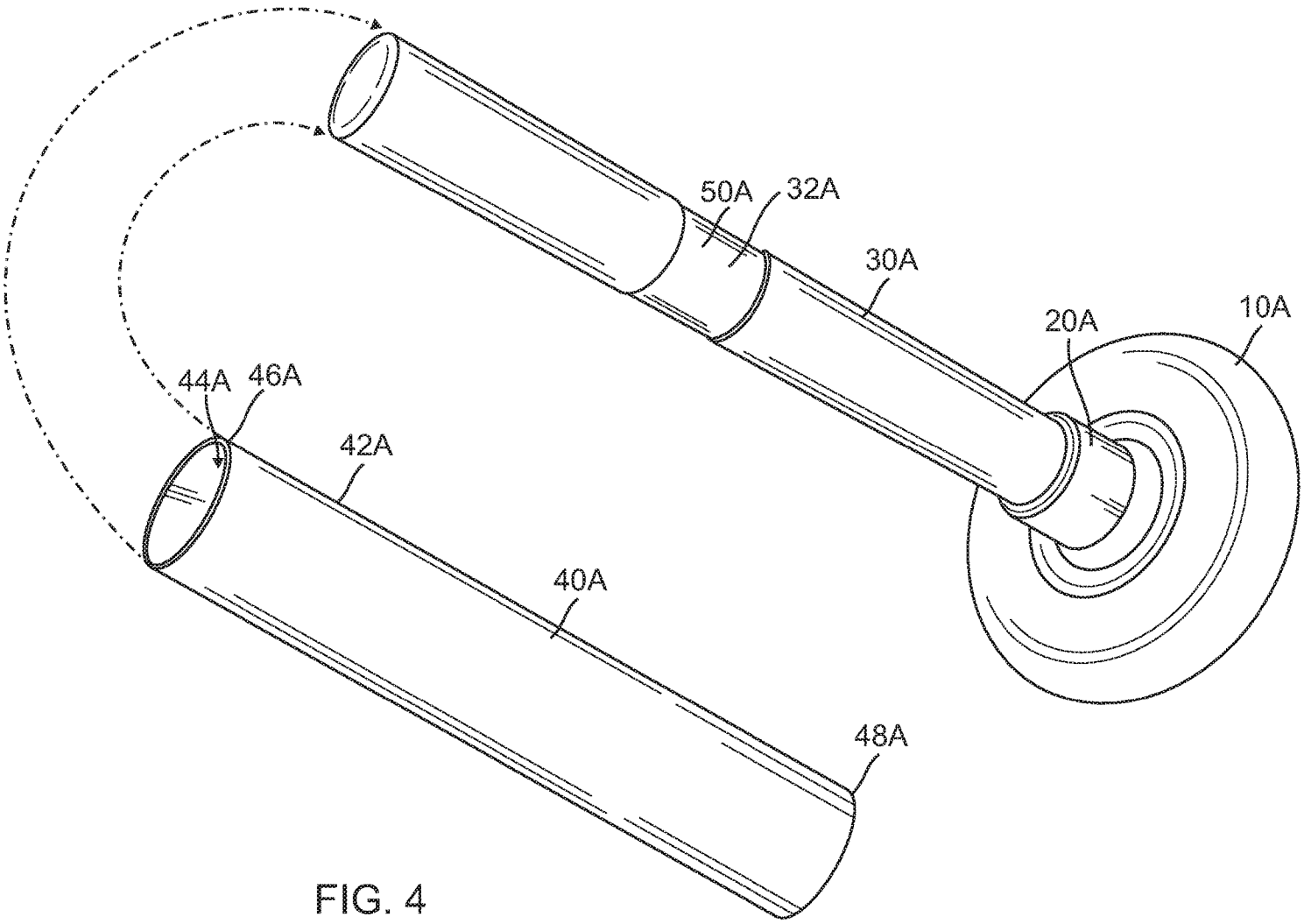
FIG. 4 is an exploded view of the shaft extending from the roller with a locking member within the shaft and a plastic tube to be inserted onto the shaft of the roller.

Referring to FIG. 4, there is illustrated a perspective view of a alternative embodiment of the present invention which includes a conventional roller wheel 10A which is placed into a track of a garage door so that a garage door can be rolled up and down with a pair of oppositely disposed rollers respectively set within oppositely disposed tracks adjacent opposite ends of the garage door. The roller wheel 10A includes a collar 20A with the roller shaft 30A retained into the roller wheel 10A by the collar 20A. The innovation of the present invention is to retain a plastic tube or tire 40A made out of material as described above selected from the group consisting of hard thermoplastic (such as Delrin), polyurethane and durable synthetic plastics. The plastic tube or tire 40A has a cylindrical outer wall 42 and a cylindrical inner chamber 44A surrounded by the cylindrical outer wall 42A and open at both a first end 46A and a second end 48A. A tube retaining member 50A is formed into the outer cylindrical wall 32A of the roller shaft 30A. As illustrated in FIG. 4, detents or at least one locking member 50A are cut or otherwise formed into the outer wall 32A of roller shaft 30A.

The plastic tube 40A is injection molded onto the roller shaft 30A and retained thereon by the at least one locking member 50A so that the plastic tube 40A is securely retained on the roller shaft 30A.

Figure 5:
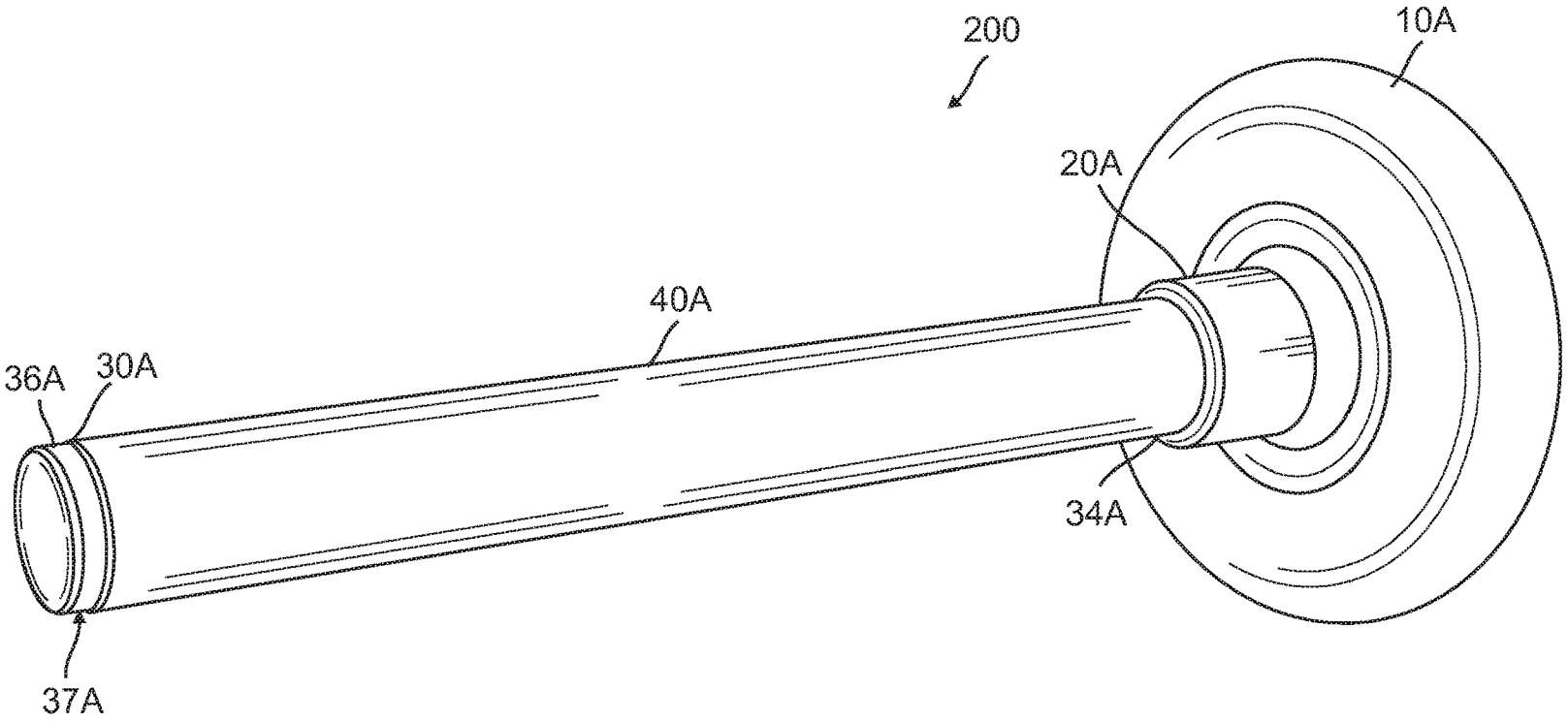
FIG. 5 is a top view of the completed embodiment of the plastic tube affixed onto the roller shaft.

Referring to FIG. 5, there is illustrated a perspective view of the completed alternative embodiment of the present invention roller wheel assembly 200 which includes the roller wheel 10A, the plastic tube 40A encircling the metal shaft 30A retained at a first end 34A through the collar 20A and into the roller wheel 10A, the plastic tube 40A having been retained onto the metal shaft 30A. A detent 37A is at the second end 36A of the metal shaft 30A to be crimped or have a retention member thereon to prevent the metal shaft from sliding out of the brackets of the hinge member (See FIG. 6).

Figure 6:
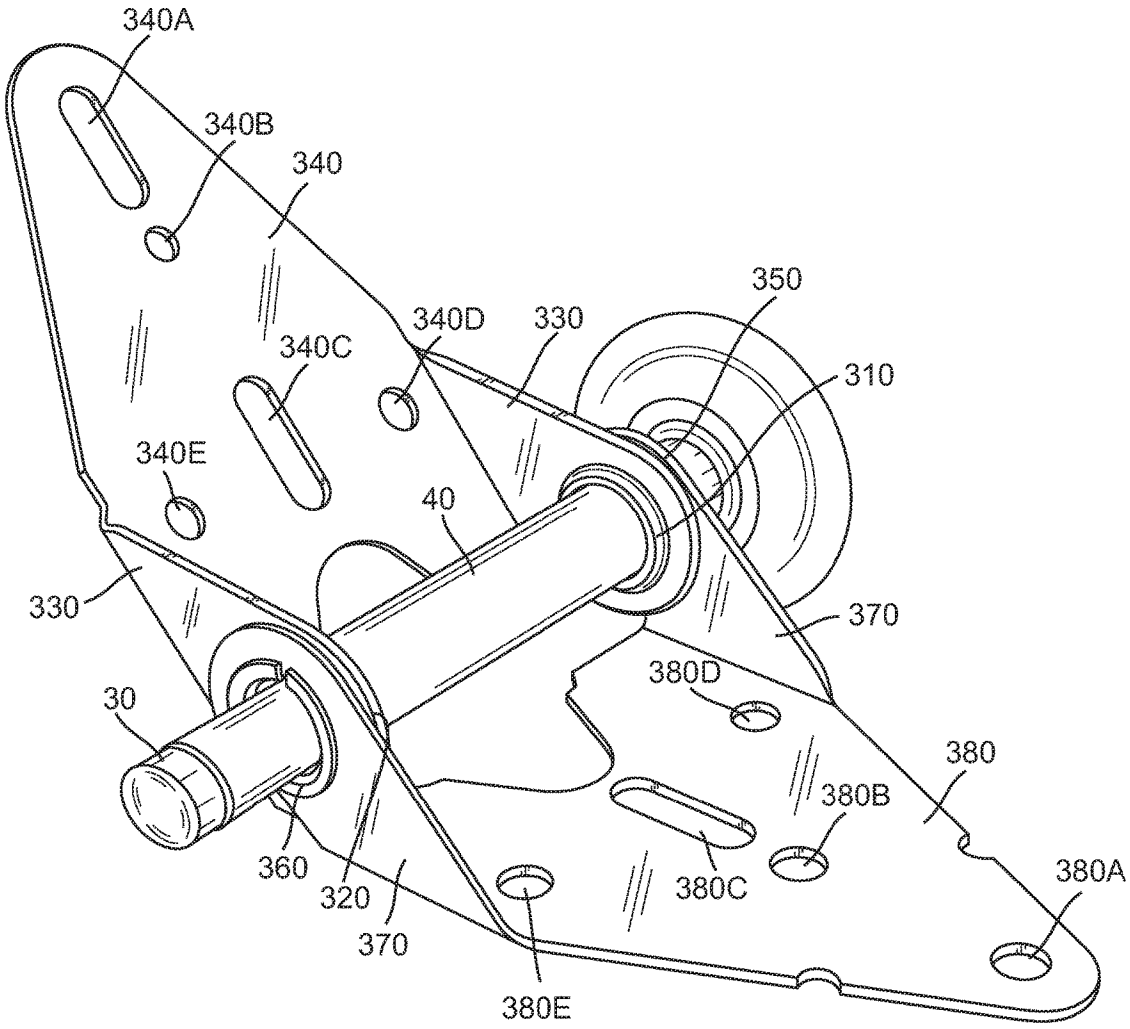
FIG. 6 is a perspective view of the new and improved rolled plastic lined roller shaft affixed through openings in the hinge plate which affixes the assembly to the back of a garage door which enables the track roller to roll up and down the track and eliminates the noise between the shaft of the roller and the metal portions of the hinge plate due to the fact that the shaft of the roller is now covered with plastic which is affixed onto the shaft of the roller so that the plastic shaft reduces noise and assure that the plastic shaft will not roll or fall off the shaft of the roller.

Referring to FIG. 6, there is illustrated a perspective view of the new and improved plastic lined roller shaft 30 affixed through openings 310 and 320 in hinge bracket 330 affixed to first hinge plate 340 and openings 350 and 360 in hinge bracket 370 affixed to hinge plate 380. First hinge plate 340 has a multiplicity of openings 340A, 340B, 340C, 340D, and 340E through which fastening members affix first hinge plate 340 to the back of a garage door panel. Second hinge plate 380 has a multiplicity of openings 380A, 340B, 340C, 380D, and 380E through which fastening members affix second hinge plate 380 to the back of a garage door panel. The hinge plates 340 and 380 are respectively affixed at the location of two adjacent garage door panels which enables the roller wheel 10 to roll up and down a track (with an opposite roller wheel inside an opposite track) to enable the garage door to move up and downwardly.

The plastic tube 40 covering the roller shaft 30 eliminates metal to metal contact between the roller shaft 30 and the metal brackets 330 and 370 and metal hinge plates 340 and 380 to thereby significantly reduce the noise between the roller shaft 30 and the metal portions of the hinge brackets and hinge plates of the hinge as the garage door is moved upward and downwards.

The roller shaft can be covered with a plastic tube such as 40 or 40A and retained on the roller shaft 30 by retaining members such as treads, threads, screw threads, detents or other locking members. The roller shaft can also be coated with plastic and also the plastic can be heat formed or molded onto the roller shaft 30. The plastic covering also creates a tight press fit with the openings 310, 320, 350 and 360 with the hinge brackets 340 and 380 to further reduce noise and assure that the plastic shaft will not roll or fall out of the hinge brackets 340 and 380. The plastic coating on the roller shaft causing the plastic to abut against the openings 310, 320, 350 and 360 and therefore, the rattling noise of metal-to-metal contact known in the prior art is eliminated so that there is a much quieter action of the garage door roller as it rolls up and down the garage door track.

Figure 7:
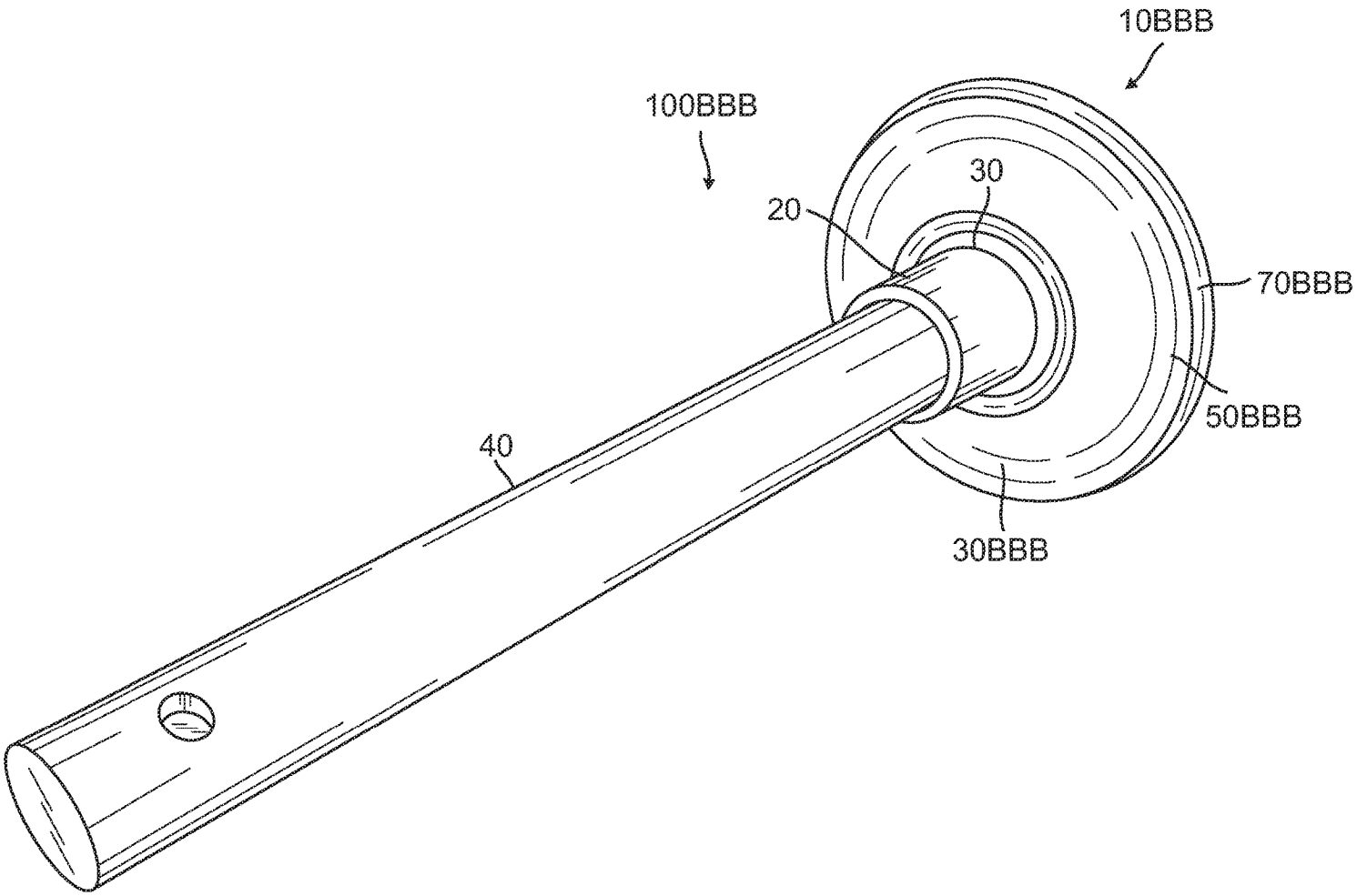
FIG. 7 is a perspective view of the new and improved roller wheel with a sealed seven ball bearing circumferential middle cover and the roller covered with a steel cover which in turn is covered with the present invention 50-90 durometer soft urethane plastic.

Referring to FIG. 7, there is illustrated a perspective view of the new and improved roller wheel with a sealed seven ball bearing circumferential middle cover seal and the roller covered with a steel cover which is covered with the present invention 50-90 durometer soft urethane plastic.

Figure 8:
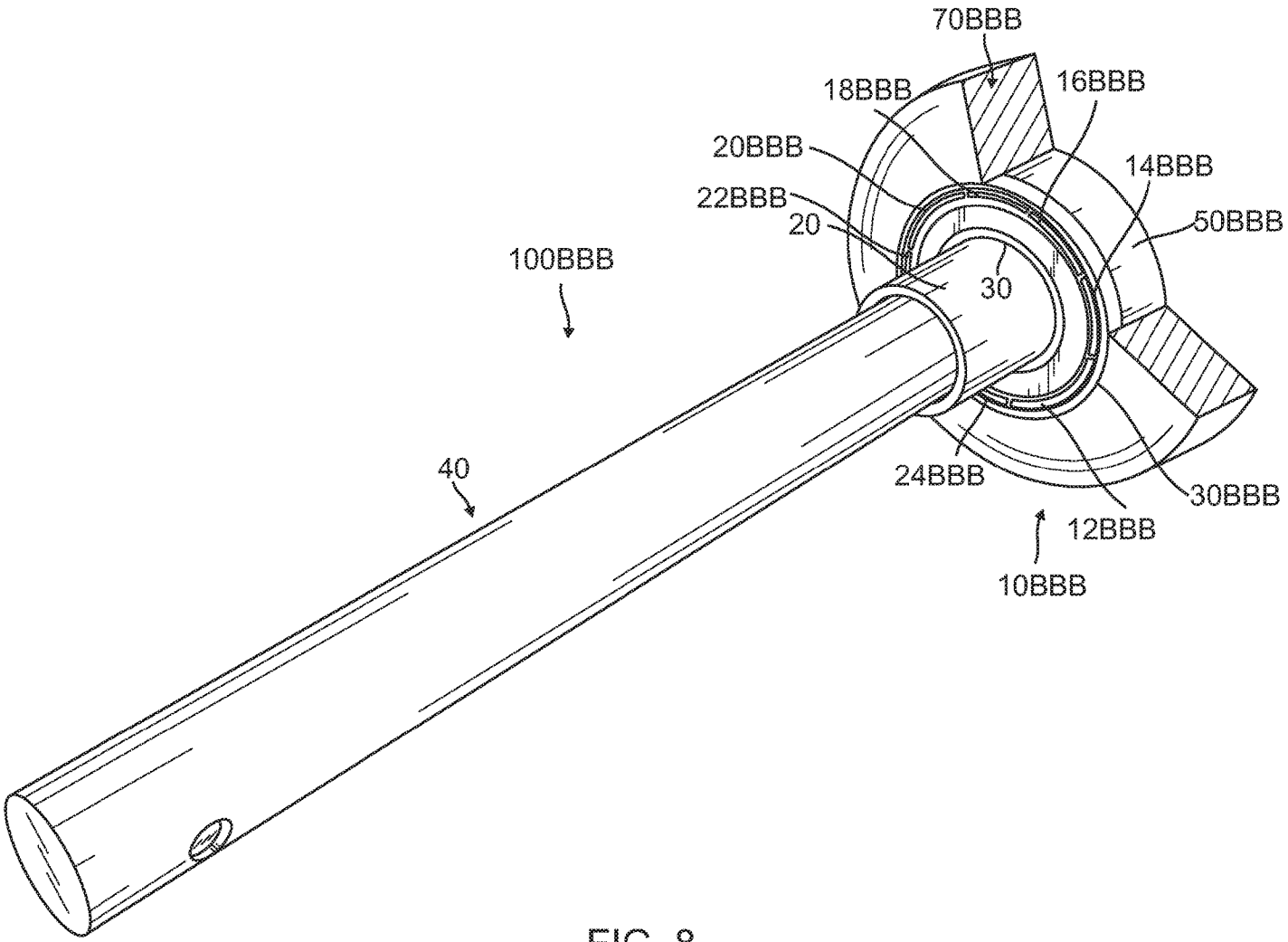
FIG. 8 is a perspective view of the new and improved roller wheel with a sealed seven ball bearing circumferential middle cover and the roller covered with a steel cover which in turn is covered with the present invention 50-90 durometer soft urethane plastic, with the roller illustrated in cross-section.
Figure 9:
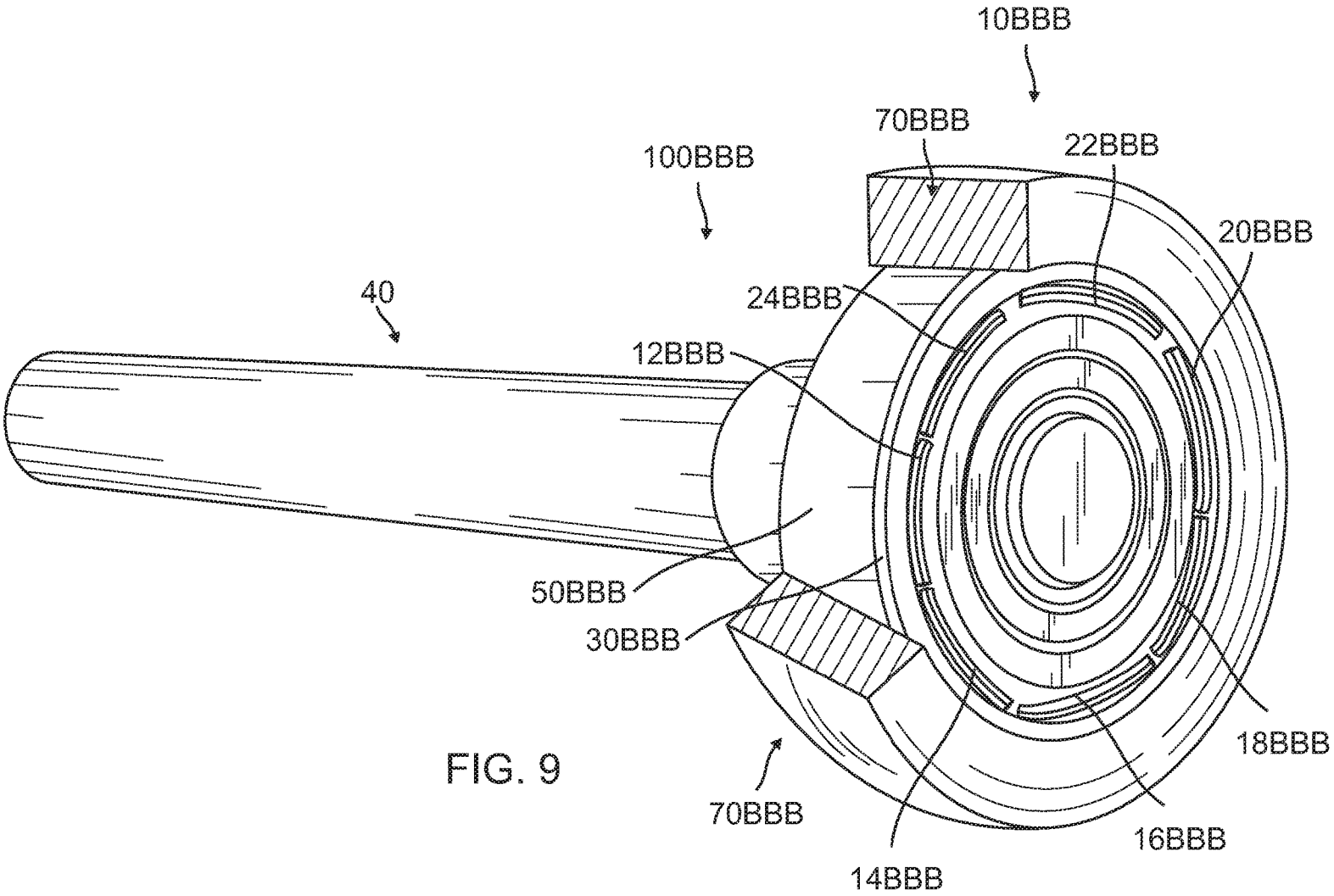
FIG. 9 is a perspective view of the new and improved roller wheel with a sealed seven ball bearing circumferential middle cover and the roller covered with a steel cover which in turn is covered with the present invention 50-90 durometer soft urethane plastic, with the roller illustrated in cross-section, the view taken from an opposite end of the roller.

Referring to FIG. 8, there is illustrated a perspective view of the new and improved roller wheel with a sealed seven ball bearing assembly including circumferential cylindrical middle cover seal and the circumferential cylindrical middle cover seal is covered with a steel cover, the steel cover is covered with the present invention 50-90 durometer soft urethane plastic, with the roller illustrated in cross-section. Referring to FIG. 9, there is illustrated a perspective view of the new and improved roller wheel with a sealed seven ball bearing circumferential cylindrical middle cover seal and the circumferential middle cover seal is covered with a steel cover, which is covered with the present invention 50-90 durometer soft urethane plastic, with the roller illustrated in cross-section.

Other components of the present invention roller wheel 100BB include a collar 20 along with ball bearings retained in the ball bearing circumferential middle cover seal. The collar retains a metal roller shaft 30 covered by a plastic tube, tube 40 incorporated as part of a garage door hinge as discussed above and illustrated in FIGS. 1, 7, 8 and 9. The additional improvement are in the roller wheel 10BBB which is adapted to roll within a track of a garage door as the garage door rolls up and down.

The roller wheel 10BBB includes seven (7) ball bearings 12BBB, 14BBB, 16BBB, 18BBBB, 20BBBB, 22BBB, and 24BBB in a ball bearing circumferential cylindrical middle cover seal 30BBB also retaining collar 20. A steel cover 50BBB encircles the ball bearing circumferential cylindrical middle cover seal 30BBB. The present invention 50-90 durometer soft urethane plastic 70BBB covers the steel cover 50BBB and provides the significant noise reduction from the noise created by the roller wheel rolling inside the garage door track. The seven ball bearings also improve the rolling movement of the roller wheel 10BBB inside the garage door track. It is also within the spirit and scope of the present invention for there to be any number of ball bearings which is at least one or any multiplicity of ball bearings from 2 to 20 retained inn the ball bearing circumferential middle cover seal. bearings. The improved roller wheel 10BBB and the other invention components operate the same way as discussed in FIG. 6.

It will be appreciated that the hinge 100 includes a collar 20 retaining a respective end of the roller shaft 30 (the roller shaft covered by the plastic tube 40). Each collar is retained by a roller wheel, either 10 or 10BBB as previously described.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A hinge configured for use with two adjacent garage door panels of a garage door, a roller wheel rollable within a track adjacent an exterior edge of each of the two adjacent garage door panels, a cylindrical metal roller shaft affixed to the roller wheel and extending perpendicular to the roller wheel, the cylindrical metal roller shaft adapted for use with the hinge, the hinge comprising:

a. a first hinge plate made of metal and affixed to a first hinge bracket made of metal having parallel oppositely disposed metal openings through the first hinge bracket made of metal;

b. a second hinge plate made of metal and affixed to a second hinge bracket made of metal having parallel oppositely disposed metal openings through the second hinge bracket made of metal;

c. the second hinge bracket made of metal exterior to the first hinge bracket made of metal, the parallel oppositely disposed openings in the second hinge bracket made of metal respectively aligned with, exterior to and adjacent to respective ones of the parallel oppositely disposed openings in the first hinge bracket made of metal;

d. the first hinge plate made of metal having a plurality of openings through which first fastening members affix the first hinge plate made of metal to a back of a first of said two adjacent garage door panels;

e. the second hinge plate made of metal having a plurality of openings through which second fastening members affix the second hinge plate made of metal to a back of a second of said two adjacent garage door panels;

f. the cylindrical metal roller shaft having an outer wall having a diameter between 10 mm and 11 mm, a tube retaining member selected from the group consisting of treads, threads and screw threads, the tube retaining member cut into a portion in the outer cylindrical wall of the cylindrical metal roller shaft;

g. an exterior plastic material selected from the group consisting of polyurethane and synthetic plastic injection molded onto at least a portion of the tube retaining member to form a combination exterior plastic tube and cylindrical metal roller shaft having a combined diameter of 12 mm;

h. the combination injection molded plastic tube and cylindrical metal roller shaft inserted through an opening in the second hinge bracket made of metal, through an adjacent aligned opening in the first hinge bracket made of metal, through another opening in the first hinge bracket made of metal and through an adjacent another aligned opening in the second hinge bracket made of metal with no metal retaining member between the combination injection molded plastic tube and cylindrical metal roller shaft and the aligned openings in the first and second hinge brackets made of metal so that the injection molded plastic tube covers the cylindrical metal roller shaft at the locations of and between the aligned openings in the second hinge bracket made of metal and adjacent first hinge bracket made of metal and another first hinge bracket made of metal and adjacent another second hinge bracket made of metal, a portion of the cylindrical metal roller shaft not covered by the injection molded plastic tube having the outer cylindrical surface retained at one end of the cylindrical metal roller shaft through the roller wheel, and after insertion of the combination injection molded plastic tube and cylindrical metal roller shaft through an opening in the second hinge bracket made of metal, through an adjacent aligned opening in the first hinge bracket made of metal, through another opening in the first hinge bracket made of metal and through an adjacent another aligned opening in the second hinge bracket made of metal, an opposite end of the cylindrical metal roller shaft also not covered by the injection molded plastic tube;

i. said roller wheel including seven ball bearings and a collar retained in a circumferential middle cover seal and the circumferential cylindrical middle cover seal covered with a steel cover, the steel cover covered with urethane plastic, the collar retaining said cylindrical metal roller shaft in the roller wheel; and j. the combination injection molded plastic tube and cylindrical metal roller shaft having an exterior surface of the injection molded plastic tube with a diameter of 12 mm which is greater than the 10 mm-11 mm diameter of the outer wall of the cylindrical metal roller shaft, each of the aligned openings in the first hinge bracket made of metal and the second hinge bracket made of metal having a diameter larger than 12 mm;

k. wherein, the combination injection molded plastic tube and cylindrical meta roller shaft prevents metal to metal contact between the outer wall of the cylindrical metal roller shaft and the first hinge bracket made of metal and the second hinge bracket made of metal.

2. A hinge configured for use with two adjacent garage door panels of a garage door, a roller wheel rollable within a garage door track adjacent an exterior edge of each of the two adjacent garage door panels, a cylindrical metal shaft affixed to the roller wheel and extending perpendicular to the roller wheel, the cylindrical metal shaft adapted for use with the hinge, the hinge comprising:

a. a first hinge plate affixed to a first hinge bracket made of metal having parallel oppositely disposed metal openings through the first hinge bracket made of metal;

b. a second hinge plate affixed to a second hinge bracket made of metal having parallel oppositely disposed metal openings through the second hinge bracket made of metal;

c. the second hinge bracket made of metal exterior to the first hinge bracket made of metal, the parallel oppositely disposed openings in the second hinge bracket made of metal respectively aligned with, exterior to and adjacent to respective ones of the parallel oppositely disposed openings in the first hinge bracket made of metal;

d. the first hinge plate affixed to a back of a first of said two adjacent garage door panels;

e. the second hinge plate affixed to a back of a second of said two adjacent garage door panels;

f. the cylindrical metal shaft having an outer wall having a diameter, a tube retaining member incorporated with at least a portion of the outer cylindrical wall of the cylindrical metal shaft;

g. an exterior plastic material selected from the group consisting of polyurethane and synthetic plastic formed onto at least a portion of the tube retaining member to form a combination exterior plastic tube and cylindrical metal shaft with the exterior plastic tube having an exterior surface having a diameter;

h. the combination exterior plastic tube and cylindrical metal roller shaft inserted through an opening in the second hinge bracket made of metal, through an adjacent aligned opening in the first hinge bracket made of metal, through another opening in the first hinge bracket made of metal and through an adjacent another aligned opening in the second hinge bracket made of metal with no metal retaining member between the combination exterior plastic tube and cylindrical metal roller shaft and the aligned openings in the first and second hinge brackets made of metal so that the exterior plastic tube covers the cylindrical metal roller shaft at the locations of and between the aligned openings in the second hinge bracket made of metal and adjacent first hinge bracket made of metal and another first hinge bracket made of metal and adjacent another second hinge bracket made of metal, a portion of the cylindrical metal roller shaft not covered by the exterior plastic tube having the outer cylindrical surface retained at one end of the cylindrical metal roller shaft through the roller wheel and after insertion of the combination exterior plastic tube and cylindrical metal roller shaft through an opening in the second hinge bracket made of metal, through an adjacent aligned opening in the first hinge bracket made of metal, through another opening in the first hinge bracket made of metal and through an adjacent another aligned opening in the second hinge bracket made of metal, an opposite end of the cylindrical metal roller shaft also not covered by the exterior plastic tube;

i. said roller wheel including seven ball bearings and a collar retained in a circumferential middle cover seal and the circumferential cylindrical middle cover seal covered with a steel cover, the steel cover covered with urethane plastic, the collar retaining said cylindrical metal roller shaft in the roller wheel; and j. the combination exterior plastic tube and cylindrical metal shaft having a diameter of the exterior surface of the exterior plastic tube which diameter is greater than the diameter of the exterior wall of the cylindrical metal shaft, each of the aligned openings in the first hinge bracket made of metal and the second hinge bracket made of metal having a diameter larger than the diameter of the exterior surface of the plastic tube of the combination plastic tube and cylindrical metal shaft;

k. wherein, the combination plastic tube and cylindrical metal shaft prevents metal to metal contact between the outer wall of the cylindrical metal shaft and the first hinge bracket made of metal and the second hinge bracket made of metal.

3. A hinge configured for use with two adjacent garage door panels of a garage door, a roller wheel rollable within a garage door track adjacent an exterior edge of each of the two adjacent garage door panels, a metal roller shaft affixed to the roller wheel and extending perpendicular to the roller wheel, the metal roller shaft adapted for use with the hinge, the hinge comprising:

a. a first hinge plate affixed to a first hinge bracket made of metal having parallel oppositely disposed metal openings through the first hinge bracket made of metal;

b. a second hinge plate affixed to a second hinge bracket made of metal having parallel oppositely disposed metal openings through the second hinge bracket made of metal;

c. the second hinge bracket made of metal exterior to the first hinge bracket made of metal, the parallel oppositely disposed openings in the second hinge bracket made of metal respectively aligned with, exterior to and adjacent to respective ones of the parallel oppositely disposed openings in the first hinge bracket made of metal;

d. the first hinge plate affixed to a back of a first of said two adjacent garage door panels;

e. the second hinge plate affixed to a back of a second of said two adjacent garage door panels;

f. the metal roller shaft having an outer wall having a diameter, a tube retaining member incorporated with at least a portion of the outer wall of the metal roller shaft;

g. an exterior plastic material selected from the group consisting of polyurethane and synthetic plastic retained onto at least a portion of the tube retaining member to form a combination retained plastic tube an metal roller shaft with the exterior plastic tube having an exterior surface having a diameter;

h. the combination retention plastic tube and cylindrical metal roller shaft inserted through an opening in the second hinge bracket made of metal, through an adjacent aligned opening in the first hinge bracket made of metal, through another opening in the first hinge bracket made of metal and through an adjacent another aligned opening in the second hinge bracket made of metal with no metal retaining member between the combination injection molded plastic tube and cylindrical metal roller shaft and the aligned openings in the first and second hinge brackets made of metal so that the injection molded plastic tube covers the cylindrical metal roller shaft at the locations of and between the aligned openings in the second hinge bracket made of metal and adjacent first hinge bracket made of metal and another first hinge bracket made of metal and adjacent another second hinge bracket made of metal, a portion of the cylindrical metal roller shaft not covered by the retained plastic tube having the outer cylindrical surface retained at one end of the cylindrical metal roller shaft through the roller wheel and after insertion of the combination retained plastic tube and cylindrical metal roller shaft through an opening in the second hinge bracket made of metal, through an adjacent aligned opening in the first hinge bracket made of metal, through another opening in the first hinge bracket made of metal and through an adjacent another aligned opening in the second hinge bracket made of metal, an opposite end of the cylindrical metal roller shaft also not covered by the retained plastic tube;

i. said roller wheel including seven ball bearings and a collar retained in a circumferential middle cover seal and the circumferential cylindrical middle cover seal covered with a steel cover, the steel cover covered with urethane plastic, the collar retaining said cylindrical metal roller shaft in the roller wheel; and j. the combination retained plastic tube and metal roller shaft having a diameter of the exterior surface of the exterior plastic tube which diameter is greater than the diameter of the exterior wall of the metal roller shaft, each of the aligned openings in the first hinge bracket made of metal and the second hinge bracket made of metal having a diameter larger than the diameter of the exterior surface of the plastic tube of the combination retained plastic tube and metal roller shaft;

k. wherein, the combination plastic tube and metal roller shaft prevents metal to metal contact between the outer wall of the metal roller shaft and the first hinge bracket made of metal and the second hinge bracket made of metal.

* * * * *